US006362805B1

(12) United States Patent
Jeong

(10) Patent No.: US 6,362,805 B1
(45) Date of Patent: Mar. 26, 2002

(54) MODE DETECTION CIRCUIT OF LIQUID CRYSTAL DISPLAY

(75) Inventor: Tae Bo Jeong, Kyoungki-do (KR)

(73) Assignee: Hyundai Display Technology Inc., Kyoungki-do (KR)

( * ) Notice: Subject to any disclaimer, the term of this patent is extended or adjusted under 35 U.S.C. 154(b) by 0 days.

(21) Appl. No.: 09/276,415

(22) Filed: Mar. 25, 1999

(30) Foreign Application Priority Data

Mar. 27, 1998 (KR) ..... 98-10828

(51) Int. Cl.[7] ..... G09G 3/36
(52) U.S. Cl. ..... 345/99; 345/208; 345/98
(58) Field of Search ..... 345/204, 98, 99, 345/100, 208

(56) References Cited

U.S. PATENT DOCUMENTS 5,376,929 A * 12/1994 Rakolta et al. ..... 340/825.21
5,486,842 A * 1/1996 Kim ..... 345/26
5,594,763 A * 1/1997 Nimishakavi ..... 375/376
5,732,324 A * 3/1998 Rieger, III ..... 455/3.1
5,828,368 A * 10/1998 Jung ..... 345/213

OTHER PUBLICATIONS

Computer Dictionary, 1994, US, Microsoft Press.*

* cited by examiner

*Primary Examiner*—Bipin Shalwala
*Assistant Examiner*—Ricardo Osorio
(74) *Attorney, Agent, or Firm*—Ladas & Parry

(57) ABSTRACT

A mode detection circuits in LCDs is disclosed, comprising: a first mode signal detection means for detecting an enable/synchronous signal mode in response to a vertical synchronous signal and for generating a first mode detection signal; a second mode signal detection means for detecting an enable mode signal based on a data enable signal and a clock signal and for generating a second mode detection signal; a mode selection means for selecting one of a first mode detection signal and a second mode detection signal from the first mode signal detection means and the second mode signal detection means in response to a mode selection signal and for providing the selected mode detection signal as a mode determining signal.

12 Claims, 4 Drawing Sheets

MODE DETECTION CIRCUIT OF LIQUID CRYSTAL DISPLAY

BACKGROUND OF THE INVENTION

This invention relates to a mode detection circuit in a liquid crystal displays (LCDs), and more particularly to a mode detection circuit in LCDs capable of changing the priority operation mode and preventing malfunction due to a noise.

Recently, there are a data only enable mode and a data enable/synchronous mode as the operation mode of LCD modules according to notebook computer manufacturers. In the data only enable mode, only data enable signal DE is provided as a control signal and in the data enable/synchronous mode, a vertical synchronous signal Vsync and the data enable signal are provided as a control signal.

The prior LCD module has a disadvantage in that the operation mode is manually selected according to its input signals. So as to solve the problem, the method is suggested that sets an initial mode in advance and detects the input signals based on the initial mode and then changes the operation mode based on the detection of the input signal. This is, the method gives priority to the initial mode and changes the corresponding operation mode by detecting the input signals of the priority mode or the another mode which are externally provided. The method is capable of changing to the desired mode from the initial mode of the priority mode. However, when the LCD module malfunctions due to the noise mixed to the input signals, it should be fixed to the operation mode by using an external pin so that the automatic mode change does not accomplished.

SUMMARY OF THE INVENTION

It is an object of the present invention to provide a mode detection circuit in LCDs which automatically selects the priority operation mode thereof according to the mode selection signal as well as changes the operation mode according to its external input signals.

It is an aspect of the present invention to provide a mode detection circuits in LCDs, comprising: a first mode signal detection means for detecting an enable/synchronous signal mode in response to a vertical synchronous signal and for generating a first mode detection signal; a second mode signal detection means for detecting an enable mode signal based on a data enable signal and a clock signal and for generating a second mode detection signal; a mode selection means for selecting one of a first mode detection signal and a second mode detection signal from the first mode signal detection means and the second mode signal detection means in response to a mode selection signal and for providing the selected mode detection signal as a mode determining signal.

The first mode signal detection means includes: a vertical synchronous signal detection means for detecting the vertical synchronous signal and for generating the vertical synchronous detection signal; and a first mode detection signal generation means for generating the first mode detection signal from the vertical synchronous detection signal generated from the vertical synchronous signal detection means.

The vertical synchronous signal detection means includes: a first counter means for countering the vertical synchronous signal; and a first decoder means for receiving an output of the first counter portion and for confirming whether the vertical synchronous signal is regularly supplied by decoding the output of the first counter portion, or not and for generating the vertical synchronous detection signal to the first mode detection signal generation means.

The counter means includes; a first D flip flop which is triggered at a negative edge of the vertical synchronous signal and an output thereof is fed back to an input thereof through a first inverter; a second D flip flop which is triggered at a positive edge of the output of the first D flip flop and an output thereof is fed back to an input thereof through a second inverter; and a thirdd flip flop which is triggered at a positive edge of the output of the second D flip flop and an output thereof is fed back to an input thereof through a third inverter. The decoder means includes a first AND gate which receives the output of the first and third D flip flops and an inverted output of the second D flip flop and provides an output thereof as a vertical synchronous detection signal to the first mode detection signal generation means.

The first mode detection signal generation means a fourth D flip flop which is triggered at a positive edge of the vertical synchronous detection signal and receives a power voltage as an input and provides an inverted output thereof as the first mode detection signal.

The second mode signal detection means includes: a pseudo vertical synchronous signal generation means for generating a pseudo vertical synchronous signal similar to the vertical synchronous signal based on the data enable signal and the clock signal; an enable signal detection means for detecting the enable signal from the pseudo vertical synchronous signal generated from the pseudo vertical synchronous signal generation means and for generating the enable detection signal; and a second mode detection signal generation means for generating the second mode detection signal from the enable detection signal generated from the enable signal detection means.

The pseudo vertical synchronous signal generation means includes a first D flip flop which is triggered at a negative edge of the clock signal and receives the data enable signal as an input signal and provides an output as the pseudo vertical synchronous signal.

The enable signal detection means includes a counter means for counting the pseudo vertical synchronous signal; and a second decoder means for confirming whether the pseudo synchronous signal is regularly supplied by decoding the output of the counter means, or not and for generating the enable detection signal to the second mode detection signal generation means.

The enable signal detection means includes: a first D flip flop which is triggered at a negative edge of the pseudo vertical synchronous signal and an output thereof is fed back to an input thereof through a first inverter; a second D flip flop which is triggered at a positive edge of the output of the first D flip flop and an output thereof is fed back to an input thereof through a second inverter; and a third D flip flop which is triggered at a positive edge of the output of the second D flip flop and an output thereof is fed back to n input thereof through a third inverter. The second decoder means an AND gate which receives the outputs of the first and the third D flip flops and an inverted output of the second D flip flops and provides an output thereof as an enable detection signal.

The second mode detection signal generation means a D flip flop which is triggered at a positive edge of the second decoder means and receives a power voltage as an input and provides an output as the second mode detection signal to the mode selection means.

The mode selection means includes a multiplexor for selecting one of the first mode detection signal from the first mode signal detection means and the second mode detection signal from the second mode signal detection means in accordance with the mode selection signal and providing the selected mode detection signal as the mode determining signal.

It is also provided to a mode detection circuit in a liquid crystal display, comprising: a first mode signal detection means for detecting an enable/synchronous signal mode in response to a vertical synchronous signal and for generating a first mode detection signal; a second mode signal detection means for detecting an enable mode signal based on a data enable signal and a clock signal and for generating a second mode detection signal; and a mode selection means for selecting one of a first mode detection signal and a second mode detection signal from the first mode signal detection means and the second mode signal detection means in response to a mode selection signal and for providing the selected mode detection signal as a mode determining signal; wherein in an initial state, the first mode signal detection means sets the second mode of data only enable mode and the second mode signal detection means sets the first mode of enable/synchronous mode.

It is still provided to a mode detection circuit in a liquid crystal display, comprising: a first mode signal detection means for detecting an enable/synchronous signal mode in response to a vertical synchronous signal and for generating a first mode detection signal, the first mode signal detection means includes a vertical synchronous signal detection means for detecting the vertical synchronous signal and for generating the vertical synchronous detection signal; and a first mode detection signal generation means for generating the first mode detection signal from the vertical synchronous detection signal generated from the vertical synchronous signal detection means; a second mode signal detection means for detecting an enable mode signal based on a data enable signal and a clock signal and for generating a second mode detection signal, the second mode signal detection means includes a pseudo vertical synchronous signal generation means for generating a pseudo vertical synchronous signal similar to the vertical synchronous signal based on the data enable signal and the clock signal; an enable signal detection means for detecting the enable signal from the pseudo vertical synchronous signal generated from the pseudo vertical synchronous signal generation means and for generating the enable detection signal; and a second mode detection signal generation means for generating the second mode detection signal from the enable detection signal generated from the enable signal detection means; and a mode selection means for selecting one of a first mode detection signal and a second mode detection signal from the first mode signal detection means and the second mode signal detection means in response to a mode selection signal and for providing the selected mode detection signal as a mode determining signal.

DETAILED DESCRIPTION OF THE INVENTION

Figure 1:
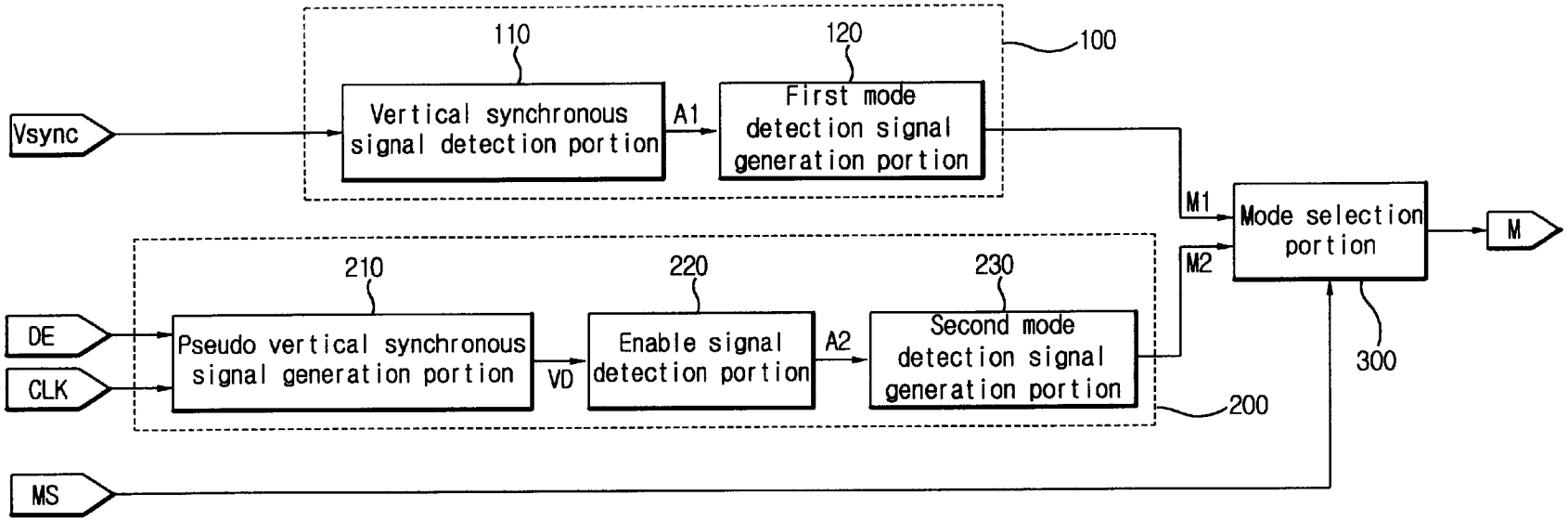
FIG. 1 is a block diagram of a mode detection circuit of a LCD in accordance with an embodiment of the present invention.

FIG.1 is a block diagram of a mode detection circuit in LCDs of the present invention. The mode detection circuit includes a first mode signal detection portion 100 for detecting an enable/synchronous mode signal as a first mode signal based on a vertical synchronous signal Vsync and for generating a first mode detection signal, a second mode signal detection portion 200 for detecting an enable mode signal as a second mode signal in response to a data enable signal DE and a clock signal CLK and for generating a second mode detection signal, and a mode selection portion 300 for selecting one of the first mode detection signal or the second mode detection signal detected from the first or the second mode signal detection portion 100 and 200 in response to a mode selection signal MS and providing the selected mode detection signal as an auto mode determining signal M.

At this time, the first mode signal detection portion 100 sets the data only enable mode as an initial mode so that a priority mode of the first mode detection portion 100 becomes the second mode. On the other hand, the second mode signal detection portion 200 sets the enable/synchronous mode as an initial mode so that a priority mode of the second mode detection becomes the first mode. Therefore, the mode detection circuit of the present invention includes the respective mode signal detection portions 100 and 200 for the data only enable mode and the enable/synchronous mode, which set the priority mode as the different modes with each other, and automatically selects the priority operation mode of LCDs according to the mode selection signal as well as changes the operation mode according to its external input signals.

The first mode signal detection portion 100 includes a vertical synchronous signal detection portion 110 for detecting the vertical synchronous signal Vsync and for generating the vertical synchronous detection signal A1 and a first mode detection signal generation portion 120 for generating a first mode detection signal M1 in response to a vertical synchronous detection signal A1 from the vertical synchronous signal detection portion 110. The second mode detection signal detection portion 200 includes a pseudo vertical synchronous signal generation portion 210 for generating a pseudo vertical synchronous signal VD which is similar to the vertical synchronous signal Vsync in response to a clock signal CLK and a data enable signal DE, an enable signal detection portion 220 for detecting an enable signal from the pseudo vertical synchronous signal VD generated from the pseudo vertical synchronous signal generation portion 210 and for generating the enable detection signal A2 and a second mode detection signal generation portion 230 for generating a second mode detection signal M2 from an enable detection signal A2 generated from the enable signal detection portion 220.

In the initial state, in case the mode selection signal is low state, the mode selection portion 300 selects the first mode signal detection signal M1 from the first mode signal detection portion 100. The first mode signal detection portion generates the first mode detection signal M1 of high state so that the second mode of data only enable mode is set as a priority mode. In case the mode selection signal is high state, the mode selection portion 300 selects the second mode detection signal M2 from the second mode signal detect ion portion 200. The second mode signal detection portion 200 generates the second mode detection signal M2 of low state so that the first mode of enable/synchronous mode is set as a priority mode.

Figure 2:
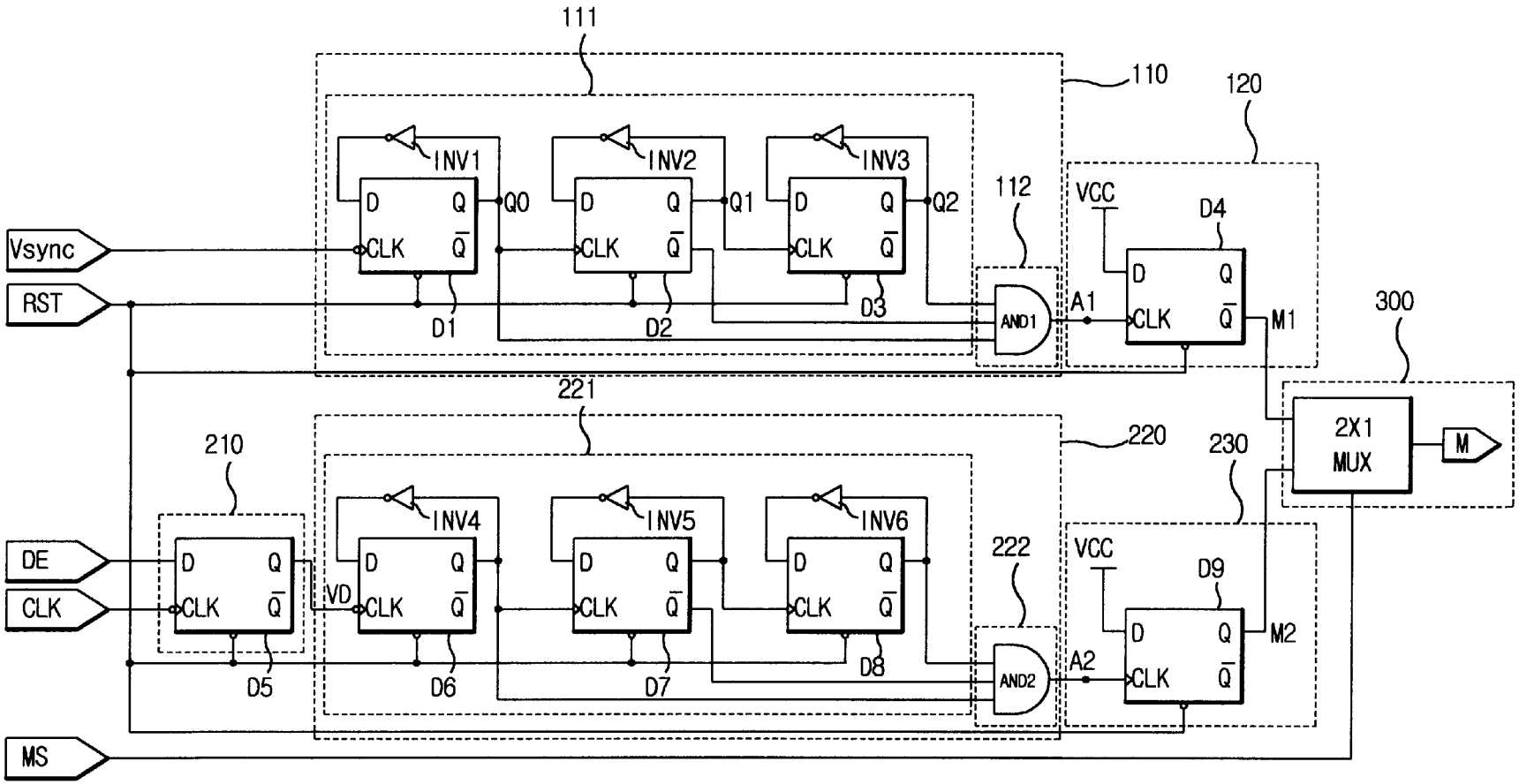
FIG. 2 is a detailed circuit diagram of the mode detection circuit in FIG. 1.

FIG. 2 shows a detailed circuit diagram of the mode detection circuit in FIG. 1. The vertical synchronous signal detection portion 110 in the first mode signal detection portion 100 includes a first 3-bit counter portion 111 for counting the vertical synchronous signal Vsync and a first decoder portion 112 for confirming whether the vertical synchronous signal is regularly supplied by decoding an output signal from the first 3-bit counter portion 111, or not and for generating the vertical synchronous detection signal A1 to the first detection signal generation portion 120.

The counter portion 111 includes a first D flip flop D1 which is triggered at a negative edge of the vertical synchronous signal Vsync and an output thereof is fed back to an input thereof through a first inverter INV1, a second D flip flop D2 which is triggered at a positive edge of the output of the first D flip flop D1 and an output thereof is fed back to an input thereof through a second inverter INV2 and a third D flip flop D3 which is triggered at a positive edge of the output of the second D flip flop D2 and an output thereof is fed back to an input thereof through a third inverter INV3. The first through the third D flip flops D1–D3 are reset by a reset signal RST. The first counter portion 111 counts the vertical synchronous signal Vsync at a negative edge of the vertical synchronous signal Vsync as a clock and provides a 3-bit binary output to the first decoder portion 112.

The first decoder portion 112 includes an AND gate which receives the output signals of the first and the third D flip flops D1 and D3 and the inverted output signal of the second D flip flop D2 and generates the vertical synchronous detection signal A1 to the first mode detection signal generation portion 120.

The first mode signal generation portion 120 includes a fourth D flip flop D4 which is triggered at a positive edge of the vertical synchronous detection signal A1 generated from the vertical synchronous signal detection portion 110 and a power voltage VCC is applied as an input signal thereof and is reset by the reset signal RST and provides an inverted output signal thereof as the first mode detection signal M1.

In the second mode detection portion 200, the pseudo vertical synchronous signal generation portion 210 includes a fifth D flip flop D5 which is triggered at a negative edge of the clock signal CLK and the data enable signal DE is applied as an input thereof and an output thereof is provided as the pseudo vertical synchronous signal VD. The enable signal detection portion 220 includes a second 3-bit counter portion 221 for counting the pseudo vertical synchronous signal VD from the pseudo vertical synchronous signal generation portion 221 and a second decoder portion 222 for confirming whether the pseudo vertical synchronous signal VD is regularly supplied by decoding an output signal from the second 3-bit counter portion 221, or not and for generating the enable detection signal A2 to the second mode detection signal generation portion 230.

The second counting portion 221 includes a sixth D flip flop D6 which is triggered at a negative edge of the pseudo vertical synchronous signal VD from the pseudo vertical synchronous signal generation portion 210 and an output thereof is fed back to an input thereof through a fourth inverter INV4 and a seventh D flip flop D7 which is triggered at a positive edge of the output of the sixth D flip flop D6 and an output thereof is fed back to an input thereof through the fifth inverter INV5 and an eight D flip flop D8 which is triggered at a positive edge of the output of the seventh D flip flop D7 and an output thereof is fed back to an input thereof through a sixth inverter INV6. The fifth through eighth D flip flops D5–D8 are reset by the reset signal RST.

The decoder portion 222 includes a second AND gate AND2 which receives the outputs of the sixth and the eighth D flip flops D6 and D8 and the output of the seventh D flip flop D7 and provides an output thereof the enable detection signal A2.

The second mode detection signal generation portion 230 includes a ninth D flip flop D9 which is triggered at a positive edge of the enable detection signal A2 and receives the power voltage VD as an input thereof and provides an output thereof as the second mode detection signal M2.

The mode selection portion 300 includes 2×1 multiplexor which selects one of the first mode detection signal M1 from the first mode detection portion 100 and the second mode detection signal M2 from the second mode detection portion 200 in response to the mode selection signal MS and provides the selected mode detection signal as the mode determining signal M.

The operation of the mode detection circuit having the above construction will be described in more detail with reference to FIG. 3A through FIG. 3K as follows.

Figure 3A:
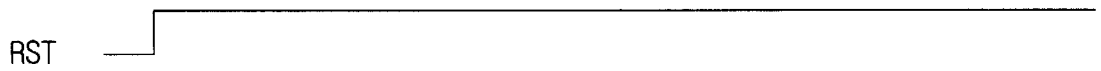
FIG. 3A through FIG. 3K are timing diagrams illustrating the operation of the mode detection circuit in FIG. 1.

Firstly, the D flip flops D1–D4 in the first mode detection portion 100 and the D flip flops D5–D9 in the second mode detection portion 200 are reset by the reset signal RST as shown in FIG. 3A.

Figure 3B:
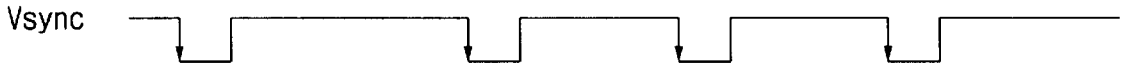
Figure 3C:
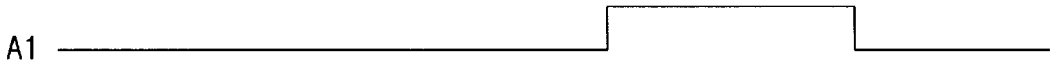

Then, the first mode detection portion 100 counters the vertical synchronous signal Vsync as shown in FIG. 3B through the first counter portion 111. The outputs of the first and the third D flip flops D1 and D3 and the inverted output of the second D flip flop D2 becomes high state at a third negative edge of the vertical synchronous signal and the AND gate AND1 outputs the vertical synchronous detection signal A1 of high state as shown in FIG. 3C at a third negative edge of the vertical synchronous signal Vsync.

Figure 3D:
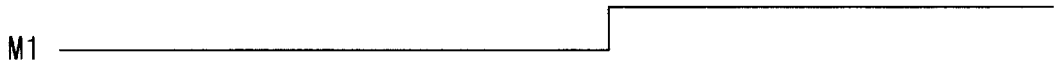

Therefore, the first mode detection signal generation portion 120 generates the first mode detection signal M1 as shown in FIG. 3D through the D flip flop D4 at a positive edge of the vertical synchronous detection signal A1.

Figure 3E:
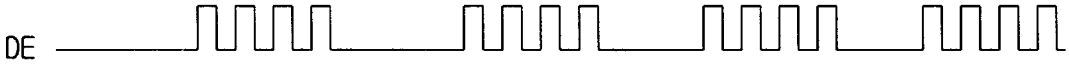
Figure 3F:
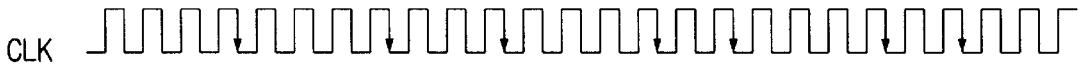
Figure 3G:
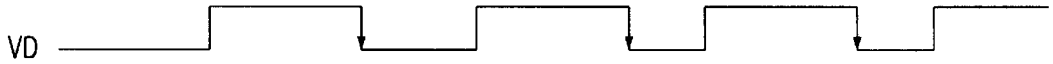
Figure 3H:
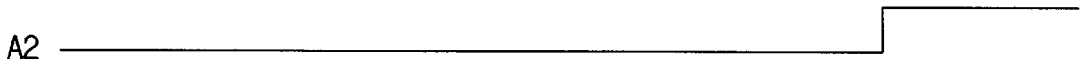
Figure 3I:
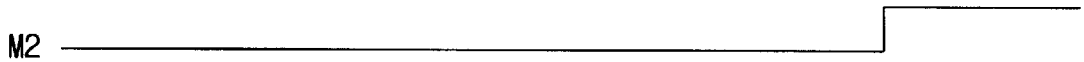

On the other hand, in the second mode detection portion 200, the pseudo vertical synchronous generation portion 210 generates the pseudo vertical synchronous signal VD as shown in FIG. 3G through the D flip flop D5 which receives the data enable signal DE and the clock signal CLK as an input signal and a clock signal thereof as shown in FIG. 3E and FIG. 3IF.

The enable signal detection portion 220 counters the pseudo vertical synchronous signal VD through the second counter portion 221. The outputs of the sixth and the eighth D flip flops D6 and D8 and the inverted output of the seventh D flip flop D7 becomes high state at a third edge of the pseudo vertical synchronous signal VD and the second decoder portion 222 generates the enable detection signal A2 of high state as shown in FIG. 3H through the second AND gate AND2 at a third edge of the pseudo vertical synchronous signal VD.

The second mode detection signal generation portion 230 generates the second mode detection signal M2 of high state as shown in FIG. 31 through the D flip flop D9 which receives the power voltage VCC and an output of the AND gate AND2 as an input signal and a clock signal thereof. At this time, the second mode detection signal generation portion 230 generates the second mode detection signal M2 at a positive edge of the enable detection signal A2.

The mode selection portion 300 selects one of the first mode detection signal M1 from the first mode detection portion 100 and the second mode detection signal M2 the second mode detection portion 200 in accordance with the mode select signal MS.

Figure 3J:
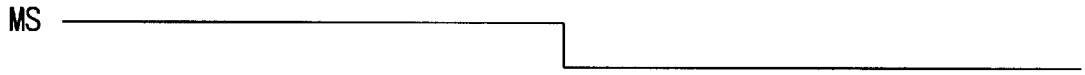
Figure 3K:
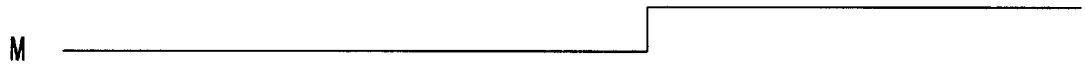

In case the mode selection signal is high state as shown in FIG. 3J, the mode selection portion 300 selects the first mode of the enable/synchronous mode as a priority mode through the multiplexor 301 and the mode determining signal M maintains low state. At this time, if the second mode detection portion 200 detects the enable signal of the second mode and generates the second mode detection signal M2 of the high state, the mode selection portion 300 generates the mode determining signal M of high state so that it changes the mode to the second mode of the data only enable mode. On the other hand, in case mode selection signal is low state as shown in FIG. 3J, the mode selection portion 300 selects the second mode of the data only enable mode as a priority mode through the multiplexor 301 and the mode determining signal M maintains high state. At this time, if the first mode detection portion 100 detects the vertical synchronous signal of the first mode and the first mode detection portion 100 generates the first mode detection signal M2 of the low state, the mode selection portion 300 generates the mode determining signal M of the low state so that it changes the mode to the first mode of the enable/synchronous mode.

According to the present invention, the mode detection includes the respective detection portions for the enable mode and the enable/synchronous mode where the priority modes are different modes.

While the invention has been particularly shown and described with respect to preferred embodiment thereof, it will be understood by those skilled in the art that various changes in form and details may be made therein without departing from the spirit and the scope of the invention as defined by the following claims.

What is claimed is:

1. A mode detection circuit in a liquid crystal display, comprising:

a first mode signal detection means for detecting an enable/synchronous signal mode in response to a vertical synchronous signal and for generating a first mode detection signal, the first mode signal detection means includes a vertical synchronous signal detection means for detecting the vertical synchronous signal and for generating the vertical synchronous detection signal; and a first mode detection signal generation means for generating the first mode detection signal from the vertical synchronous detection signal generated from the vertical synchronous signal detection means;

a second mode signal detection means for detecting an enable mode signal based on a data enable signal and a clock signal and for generating a second mode detection signal, the second mode signal detection means includes a pseudo vertical synchronous signal generation means for generating a pseudo vertical synchronous signal similar to the vertical synchronous signal based on the date enable signal and the clock signal;

an enable signal detection means for detecting the enable signal from the pseudo vertical synchronous signal generated from the pseudo vertical synchronous signal generation means and for generating the enable detection signal; and a second mode detection signal generation means for generating the second mode detection signal from the enable detection signal generated form the enable signal detection means; and a mode selection means for selecting one of a first mode detection signal and a second mode detection signal from the first mode signal detection means and the second mode signal detection means in response to a mode selection signal and for providing the selected mode detection signal as a mode determining signal.

2. The mode detection circuit as claimed in claim 1, wherein the vertical synchronous signal detection means includes:

a first counter means for counting the vertical synchronous signal; and a first decoder means for receiving an output of the first counter portion and for confirming whether the vertical synchronous signal is regularly supplied by decoding the output of the first counter portion, or not and for generating the vertical synchronous detection signal to the first mode detection signal generation means.

3. The mode detection circuit as claimed in claim 2, wherein the counter means includes;

a first D flip flop which is triggered at a negative edge of the vertical synchronous signal and an output thereof is fed back to an input thereof through a first inverter;

a second D flip flop which is triggered at a positive edge of the output of the first D flip flop and an output thereof is fed back to an input thereof through a second inverter; and a third D flip flop which is triggered at a positive edge of the output of the second D flip flop and an output thereof is fed back to an input thereof through a third inverter.

4. The mode detection circuit as claimed in claim 3, wherein the decoder means includes a first AND gate which receives the output of the first and third D flip flops and an inverted output of the second D flip flop and provides an output thereof as a vertical synchronous detection signal to the first mode detection signal generation means.

5. The mode detection circuit as claimed in claim 4, wherein the first mode detection signal generation means a fourth D flip flop which is triggered at a positive edge of the vertical synchronous detection signal and receives a power voltage as an input and provides an inverted output thereof as the first mode detection signal.

6. The mode detection circuit as claimed in claim 1, wherein the pseudo vertical synchronous signal generation means includes a first D flip flop which is trigged at a negative edge of the clock signal and receives the data enable signal as an input signal and provides an output as the pseudo vertical synchronous signal.

7. The mode detection circuit as claimed in claim 1, wherein the enable signal detection means includes counter means for counting the pseudo vertical synchronous signal; and a second decoder means for confirming whether the pseudo synchronous signal is regularly supplied by decoding the output of the counter means, or not and for generating the enable detection signal to the second mode detection signal generation means.

8. The mode detection circuit as claimed in claim 7, wherein the enable signal detection means includes:

a first D flip flop which is triggered at a negative edge of the pseudo vertical synchronous signal and an output thereof is fed back to an input thereof through a first inverter;

a second D flip flop which is triggered at a positive edge of the output of the first D flip flop and an output thereof is fed back to an input thereof through a second inverter; and a third D flip flop which is triggered at a positive edge of the output of the second D flip flop and an output thereof is fed back to n input thereof through a third inverter.

9. The mode detection circuit as claimed in claim 8, wherein a second decoder means an AND gate which receives the outputs of the first and the third D flip flops and an inverted output of the second D flip flops and provides an output thereof as an enable detection signal.

10. The mode detection circuit as claims in claim 1, wherein the second mode detection signal generation means includes a D flip flop which is triggered at a positive edge of the second decoder means and receives a power voltage as an input and provides an output as the second mode detection signal to the mode selection means.

11. The mode detection circuit as claimed in claim 1, wherein the mode selection means includes a multiplexor for selecting one of the first mode detection signal from the first mode signal detection means and the second mode detection signal from the second mode signal detection means in accordance with the mode selection signal and providing the selected mode detection signal as the mode determining signal.

12. A mode detection circuit in a liquid crystal display, comprising:

a first mode signal detection means for detecting an enable/synchronous signal mode in response to a vertical synchronous signal and for generating a first mode detection signal;

a second mode signal detection means for detecting an enable mode signal based on a date enable signal and a clock signal and for generating a second mode detection signal;

a mode selection means for selecting one of a first mode detection signal and a second mode detection signal from the first mode signal detection means and the second mode signal detection means in response to a mode selection signal and for providing the selected mode detection signal as a mode determining signal;

a pseudo vertical synchronous signal generation means for generating a pseudo vertical synchronous signal similar to the vertical synchronous signal based on the date enable signal and the clock signal;

an enable signal detection means for detecting the enable signal from the pseudo vertical synchronous signal generated from the pseudo vertical synchronous signal generation means and for generating the enable detection signal; and wherein in an initial state, the first mode signal detection means sets the second mode of date only enable mode and the second mode signal detection means sets the first mode of enable/synchronous mode, and selects the priority operation mode according to the mode selection signal as well as changes the operation mode according to its external input signals.

* * * * *